United States Patent [19]

Flemings et al.

[11] 4,263,959

[45] Apr. 28, 1981

[54] PROCESS FOR FORMING METAL COMPOSITIONS CONTAINING IN SITU COMPOSITES

[75] Inventors: Merton C. Flemings, Cambridge, Mass.; Kenneth P. Young, Ballwin, Mo.; Bernard A. Rickinson, Chapeltown, England

[73] Assignee: Massachusetts Institute of Technology, Cambridge, Mass.

[21] Appl. No.: 954,392

[22] Filed: Oct. 25, 1978

[51] Int. Cl.[3] ..... B22D 11/00

[52] U.S. Cl. ..... 164/51; 164/86; 164/122

[58] Field of Search ..... 164/82, 51, 86, 60, 164/122, 125–128

[56] References Cited

U.S. PATENT DOCUMENTS 3,985,177 10/1976 Buehler ..... 164/51

FOREIGN PATENT DOCUMENTS 913604 9/1946 France ..... 164/82

2040931 1/1971 France .

*Primary Examiner*—Robert D. Baldwin

*Assistant Examiner*—K. Y. Lin

*Attorney, Agent, or Firm*—Arthur A. Smith, Jr.; Paul J. Cook

[57] ABSTRACT

A process for forming metal compositions containing in situ composites. A metal composition is heated to a liquid and then solidified by being directed into a cooling zone. The metal in the small volume at or near the liquid-solid interface is heated to achieve a high temperature gradient between the solid and liquid metal while not exceeding an average temperature in the liquid which degrades the container for the liquid metal. The metal fed into the small volume can be either a liquid or a solid.

4 Claims, 2 Drawing Figures

PROCESS FOR FORMING METAL COMPOSITIONS CONTAINING IN SITU COMPOSITES

BACKGROUND OF THE INVENTION

The Government has rights in this invention pursuant to Contract No. NSG 3046 awarded by the National Aeronautics and Space Administration.

This invention relates to a process for forming metal compositions referred to as in situ composites.

As is well known, the microscopic solid structure of metals is dictated primarily by the conditions of cooling under which the solid metal is formed from its liquid composition. Metal solidification begins at the wall of the mold containing the liquid metal and proceeds inward. At any given moment during solidification, one usually finds a solid zone, a zone of liquid metal and between them a zone where liquid metal is being transferred into the solid. In the art, this latter region is termed the mushy zone.

Only when the metal is extremely pure or when special control is exercised over solidification does one find a smooth interface between the solid zone and the liquid zone. If impurities or alloying substances are present, even in small amounts, they tend to be rejected by the metal solidifying at the interface. They then lower the melting point of the liquid next to the growing solid and cause the interface to become unstable. As a result, the interface becomes jagged in that crystalline protrusions known as dendrites extend from the solid into the liquid. The shape of the dendrite or other solid protrusion depends upon the ratio of the thermal gradient in the metal (G) to the growth rate of the solid portion of the metal (R). When G/R is low, equiaxed dendritic and columnar dendritic metals are readily obtained. G/R ratios can be increased by adding heat at one end of a solidifying alloy while extracting heat at the other end. At intermediate values of G/R, cellular in situ composites appear. At high values of G/R, one obtains either of two plane front structures; either a single phase structure or a multiphase in situ composite structure.

The plane front structures have been found generally to exhibit the most improved component life under a given set of temperatures or use conditions or have been found to perform satisfactorily at higher operating temperatures as compared to the other metal structures described above. However, the temperature gradients and growth rates needed to form the in situ composites directly are undesirably time consuming and expensive thereby resulting in only limited commercial use for the metal compositions formed by these processes. With currently available equipment, directionally solidified eutectic (DES) alloys must be solidified at slow rates (less than 1 cm/hr) in order to produce the fully aligned structure which gives them their unique properties. The critical growth rate above which alignment cannot be obtained for a given temperature gradient is governed by the equation $$\frac{G}{R^*} = C$$

where G is the thermal gradient at the solidification front, R* is the critical growth rate and C is a constant. Since slow production processes generally are not economical, it is desirable that R* be as large as possible. In order to achieve this, G must be increased. The conventional way of increasing G is to increase the degree of liquid melt superheat. However, the maximum temperature at which the liquid is to be heated in order to obtain high temperature gradients is limited since the mold material will react with the liquid metal at high liquid metal temperatures. Thus, the processing benefits to be gained in forming the in situ composites directly are only minor and do not seem to justify pursuit of this approach on a commercial basis as, for example, in the production of turbine blades.

Accordingly, it would be highly desirable to provide a process for forming in situ composites which does not require the high liquid metal temperatures when forming the cellular in situ composites directly.

SUMMARY OF THE INVENTION

In accordance with this invention, a process for forming in situ composites is provided which eliminates the need for maintaining the entire liquid to be solidified at high temperatures. In the process a metal is heated to its liquid temperature and is directed to a cooling zone wherein the liquid is solidified. At or near the liquid-solid interface, a heating means is provided to superheat only a small portion of liquid adjacent the interface thereby achieving a high temperature gradient between the small portion of the liquid and the solid without the need for increasing the temperature of the entire liquid being fed to the superheated liquid. The metal fed to the superheated liquid also can be in solid form. For a given amount of solid formed, the temperature gradients achievable with the present invention are much higher than the prior art processes.

DETAILED DESCRIPTION OF SPECIFIC EMBODIMENTS

The metal utilized in the process of this invention is heated in a small zone to form a superheated liquid which is then directed to a cooling zone where it is solidified. The essential step in the present invention comprises superheating the liquid in a small zone at or near the interface between the solid metal and liquid so as to establish a high temperature gradient which permits obtaining high solidification rates while avoiding substantial reaction between the molten metal and the container for the liquid metal. This high temperature gradient is maintained as close to the solid-liquid interface as possible so as to minimize heating requirements and minimize needed cooling capacity. The amount of superheated liquid is small compared to the amount of solid being cooled so that the cooling solid is capable of withdrawing the amount of heat in the superheated to cause the superheated liquid to solidify. Higher temperature gradients can be obtained at the solid-liquid interface than can be obtained with present processes. With these higher temperature gradients, the rate of solidification also can be increased to commercially attractive levels while retaining the desired microstructure.

The metal which is solidified is drawn away from the liquid metal so that further liquid can be drawn into the cooling zone and solidified either by indirect or direct cooling. This can be affected conveniently by positioning a cooling zone adjacent the liquid-solid interface and pulling the formed solid through the cooling zone in a manner well-known in the art. In any event, the auxiliary liquid superheating means should be positioned as close to the liquid-solid interface as possible. Since the in situ composites are formed directly from the cooling liquid metal, the process of this invention provides a means for continuously forming the metal in situ composites.

Figure 1:
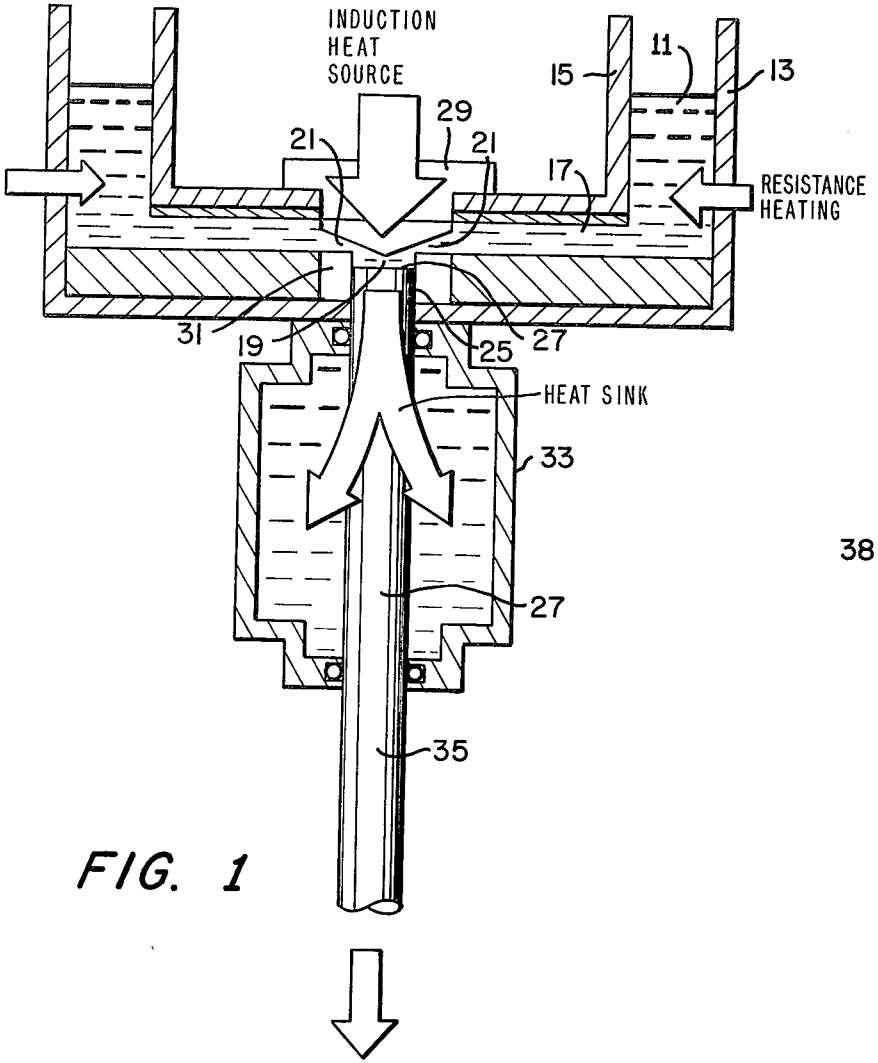
FIG. 1 is a schematic diagram illustrating the process of this invention.

The process of this invention will be described with reference to FIG. 1. A pool of liquid metal 11 is formed within walls 13 and 15 by resistance heating of the corresponding solid metal. The liquid metal is directed through channel 17 to superheating zone 9. By providing a small superheating zone 19, a maximum temperature gradient is achieved at the liquid-solid interface 27. Superheating in zone 19 is effected, for example, by induction heating through a graphite susceptor 29 or the like. The superheated liquid is passed into channel 25, defined by ceramic mold 31, wherein it is partially cooled and thence into cooling zone 33 where it is contacted directly with flowing cooled water. The solid specimen 35 is removed from cooling zone 33 continuously.

Figure 2:
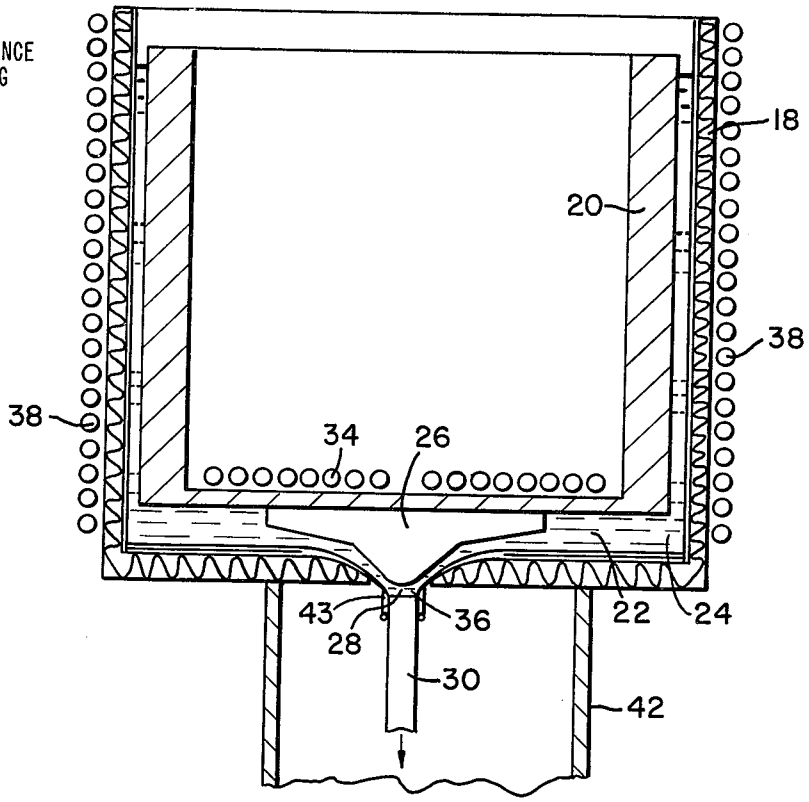
FIG. 2 is side cross-sectional view of an apparatus useful in the process of this invention.

The apparatus in FIG. 2 is useful in conducting the process of this invention. The apparatus 16 includes an outer crucible wall 18 and an inner crucible wall 20 to form an annulus space 22 into which liquid metal 24 is poured. A graphite disc 26 is attached to the inner wall 20 and contacts the liquid 28 adjacent the disc 26 and the metal rod 30 formed of previously solidified metal. The graphite disc 26 is heated by means of induction 34 so as to heat the liquid 28 at or near the liquid-solid interface 36 without heating the main body of liquid 24 in annulus 22. The liquid metal 24 is maintained liquid by means of resistance heater 38.

In operation a precast dummy bar is inserted through the cooling zone 42 through which water or other cooling liquid is passed. The graphite disc 26 is heated to melt the tip of the bar and the liquid film between the disc 26 and the bar is allowed to reach a steady state temperature profile. The bar is pulled downwardly at a constant rate by any convenient means such as powered rollers or the like (not shown). By operating in this manner, planar front solidification can be achieved within the confines of the opening 43. Heat removal is directly across the metal-water interface. Liquid alloy from pool 28 moves down to feed the solidification process continuously. Using the apparatus shown in FIG. 2 with a tin-30% lead alloy, fully composite structures have been achieved with temperature gradients effected at the graphite disc in the range of 300°–900° C./cm. To achieve a gradient of 900° C./cm, a graphite disc temperature of only 680° C. is required. In contrast, when processing the same alloy by conventional solidification means requires a liquid metal temperature of 1100° C. to achieve maximum temperature gradient of 500° C./cm.

It is to be understood that alternative embodiments to the invention specifically described above also can be utilized. For example, a susceptor need not be used and induction heating can be conducted directly through ceramic walls that define the superheating zone. In addition, superheating can be effected directly by electron beam, plasma, a laser or the like. Furthermore, the metal feed to the superheating zone can be solid as well as the liquid feed means described above.

What we now claim is:

1. The process for forming a metal composition containing in situ composites from a first metal composition which comprises feeding said first metal composition from a large zone to a small zone adjacent a cooling zone, heating the metal in the small zone to form a superheated liquid metal, said heating being effected with a heating means positioned directly above said cooling zone and in contact with said superheated liquid metal, passing said superheated liquid metal to a cooling zone to solidify said superheated liquid metal, the amount of superheated liquid metal being controlled to maximize heat flow from the superheated liquid metal to the metal being solidified while minimizing heat flow from the superheated liquid metal to the metal fed to said small zone thereby to maximize a temperature gradient between the said superheated liquid metal and said metal being solidified.

2. The process of claim 1 wherein the first metal composition is a liquid.

3. The process of claim 1 wherein the first metal composition is a solid.

4. The process of claim 1 wherein said superheating is effected by induction heating.

* * * * *